US007559825B2

(12) United States Patent
Erk et al.

(10) Patent No.: US 7,559,825 B2
(45) Date of Patent: Jul. 14, 2009

(54) METHOD OF POLISHING A SEMICONDUCTOR WAFER

(75) Inventors: Henry Frank Erk, St. Louis, MO (US); Judith Ann Schmit, St. Peters, MO (US); Roland Vandamme, Wentzville, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 50 days.

(21) Appl. No.: 11/614,129

(22) Filed: Dec. 21, 2006

(65) Prior Publication Data

US 2008/0153391 A1 Jun. 26, 2008

(51) Int. Cl.
*B24B 1/00* (2006.01)

(52) U.S. Cl. ..... 451/36; 451/41; 451/60; 451/285; 451/286; 451/287; 451/289; 451/446

(58) Field of Classification Search ..... 451/41, 451/60, 285, 286, 287, 289, 446
See application file for complete search history.

(56) References Cited

U.S. PATENT DOCUMENTS

| | | | | |
|---|---|---|---|---|
| 5,094,037 | A | 3/1992 | Hakomori | |
| 5,316,620 | A | 5/1994 | Hasegawa | |
| 5,424,224 | A | 6/1995 | Allen | |
| 5,469,849 | A | 11/1995 | Sasaki | |
| 5,595,522 | A | 1/1997 | Simpson | |
| 5,866,477 | A | 2/1999 | Ogawa | |
| 5,882,539 | A * | 3/1999 | Hasegawa et al. | 216/88 |
| 6,050,885 | A * | 4/2000 | Morsch et al. | 451/287 |
| 6,265,314 | B1 * | 7/2001 | Black et al. | 438/690 |
| 6,328,641 | B1 | 12/2001 | Ang | |
| 6,622,334 | B1 | 9/2003 | Ziemins | |
| 6,629,875 | B2 | 10/2003 | Steere, III | |
| 6,641,464 | B1 | 11/2003 | Steere, III | |
| 6,824,446 | B1 | 11/2004 | Ang | |
| 6,837,777 | B2 | 1/2005 | Ziemins | |
| 6,840,841 | B2 | 1/2005 | Hakomori | |
| 6,844,929 | B2 * | 1/2005 | Glenn et al. | 356/244 |
| 6,913,520 | B1 | 7/2005 | Liao | |
| 6,962,521 | B2 | 11/2005 | Mizushima | |
| 7,043,129 | B2 | 5/2006 | Auner | |
| 7,066,787 | B2 * | 6/2006 | Nakanishi et al. | 451/6 |
| 7,182,673 | B2 * | 2/2007 | Hardikar et al. | 451/41 |
| 2003/0153251 | A1 | 8/2003 | Mizushima | |

FOREIGN PATENT DOCUMENTS

| | | |
|---|---|---|
| EP | 1000703 A2 | 5/2000 |
| EP | 1004400 A1 | 5/2000 |

(Continued)

*Primary Examiner*—Joseph J Hail, III
*Assistant Examiner*—Shantese McDonald
(74) *Attorney, Agent, or Firm*—Armstrong Teasdale LLP

(57) ABSTRACT

Semiconductor wafers have a front surface, a back surface, a notch, and an edge. A method of polishing a wafer includes polishing at least one of the surfaces and the notch of the wafer using a polishing pad and slurry. At least one surface of the wafer is cleaned of residual slurry. The cleaned surface is grasped by applying a vacuum to the cleaned surface of the wafer using a vacuum chuck. Edge of the wafer is polished using a pad and slurry while the wafer is grasped by the vacuum chuck.

21 Claims, 6 Drawing Sheets

FOREIGN PATENT DOCUMENTS

| | | | |
|---|---|---|---|
| EP | 1120191 | A2 | 8/2001 |
| EP | 1447840 | A1 | 8/2004 |
| JP | 54111284 | | 8/1979 |
| JP | 57096766 | | 6/1982 |
| JP | 61100371 | | 5/1986 |
| JP | 2301135 | | 12/1990 |
| JP | 3003705 | | 1/1991 |
| JP | 3076221 | | 4/1991 |
| JP | 5006881 | | 1/1993 |
| JP | 5123952 | | 5/1993 |
| JP | 5123955 | | 5/1993 |
| JP | 5152260 | | 6/1993 |
| JP | 5182939 | | 7/1993 |
| JP | 5329759 | | 12/1993 |
| JP | 7040213 | | 2/1995 |
| JP | 8001494 | | 1/1996 |
| JP | 9057584 | | 3/1997 |
| JP | 9057585 | | 3/1997 |
| JP | 9057586 | | 3/1997 |
| JP | 9168953 | | 6/1997 |
| JP | 10100051 | | 4/1998 |
| JP | 10100052 | | 4/1998 |
| JP | 10100053 | | 4/1998 |
| JP | 10100055 | | 4/1998 |
| JP | 11070449 | | 3/1999 |
| JP | 11070450 | | 3/1999 |
| JP | 11221744 | | 8/1999 |
| JP | 11221745 | | 8/1999 |
| JP | 2000061789 | | 2/2000 |
| JP | 2000202766 | | 7/2000 |
| JP | 2000288887 | | 10/2000 |
| JP | 2001293653 | | 10/2001 |
| JP | 2001300837 | | 10/2001 |
| JP | 2001300846 | | 10/2001 |
| JP | 2002110593 | | 4/2002 |
| JP | 2002192446 | | 7/2002 |
| JP | 2003007658 | | 1/2003 |
| JP | 2003297777 | | 10/2003 |
| JP | 2003297778 | | 10/2003 |
| JP | 2005191179 | | 7/2005 |
| JP | 2005305586 | | 11/2005 |
| JP | 2006114643 | | 4/2006 |
| JP | 2006114766 | | 4/2006 |

* cited by examiner

METHOD OF POLISHING A SEMICONDUCTOR WAFER

FIELD OF THE INVENTION

The present invention generally relates to the manufacture of semiconductor wafers and more particularly, to a method of polishing semiconductor wafers.

BACKGROUND OF THE INVENTION

Semiconductor wafers are generally prepared from a single crystal ingot (e.g., a silicon ingot) which is trimmed and ground to have one or more flats for proper orientation of the wafer in subsequent procedures. The ingot is then sliced into individual wafers. The individual wafers are subjected to a number of processing operations to reduce the thickness of the wafer, remove damage caused by the slicing and/or other processing operations, and to create at least one highly reflective surface (e.g., on a front surface of the wafer).

In addition to having at least one highly reflective surface, semiconductor wafers for advanced applications need to have edges that are smooth, damage-free, and polished. Damaged edges may cause edge slip during thermal processing of the wafer. In addition, rough or pitted edges may trap particles that can be later released in a wet cleaning bath. The released particles may then undesirably migrate to the surface of the wafer. Furthermore, various films are deposited onto the wafer surface in some applications, which may deposit at the edge of the wafer. If the edge is not sufficiently smooth, residual film deposits at the edge may flake off. The flakes may come into contact with the surface of the wafer thereby causing surface defects.

To avoid these and other potential problems, the edges of the wafer are polished. In addition to the edge, semiconductor wafers for advanced applications have an orientation notch that must also be polished. Typical notch and edge polishing tools remove dry wafers from a process cassette, aligns the notch in the wafers, polishes the notch in the wafers, polishes the edge of the wafers, scrubs and/or cleans the wafers, spin dries the wafers, and then returns the dry wafers to the process cassette where the wafers can be moved to the next station.

Semiconductor wafers for advanced applications are often double-sided polished (commonly referred to as DPOL) to obtain highly reflective surfaces on the wafer. The reason for using double-sided polishing instead of other surface polishing methods is two fold. The double-sided polishing process generally produces a wafer that is extremely flat, parallel and with minimal surface topology (nanotopology) on both the front and back surfaces of the wafer. Good flatness is required for advanced lithography of scanners to permit even smaller sizes for the so-called critical dimension (CD). Low surface topology, especially on the back surface of the wafer is required to maximize CMP film removal uniformity and minimize film over-polish or film under-polish.

Accordingly, semiconductor wafers for advanced applications are commonly both edge polished and double-sided polished. Often, the edge of the wafer is polished first because the edge-polishing process can contaminate the front and back surface of the wafer with silica, which is one of the constituents of polishing slurry used during edge polishing. After the edge is polished, the wafer is double-side polished. Unfortunately, during the double-sided polishing process, the polished edge of the wafer is damaged in at least two ways. Because of the high pH of the polishing slurry, the temperature of the wafer and slurry, and duration of the process, the edge of the wafer is roughened by the alkaline etching of the slurry. Since the edge of the wafer is not in contact with a polishing pad that contains slurry, the polished edge is roughened because of etching in the absence of polishing. In addition, an apex of the edge of the wafer contacts a plastic-lined insert of a double-sided polishing carrier. During rotation of the wafer during the double-sided polishing process, the edge of the wafer wears against the insert and both the wafer edge (apex) and the insert are degraded. As a result, the apex of the edge of the wafer develops striations.

If, however, the edge of the wafer is polished after double-sided polishing, a smooth edge can be produced. Any roughening by alkaline etching or any abrasion striations produced by the carrier insert can be removed by edge polishing. Unfortunately, the polished surfaces of the wafer can be stained or damaged by a wafer vacuum chuck that is used to hold the wafer during edge polishing. FIG. 1, for example, shows a chuck mark that was formed by the vacuum chuck during edge polishing of the wafer. FIG. 2 shows a stackmap from a Raytex Corporation's (Tokyo, Japan) EdgeScan B+ surface inspection tool of the chucked side of 20 wafers. As shown, the wafer vacuum chuck can damage the chucked surface of the wafer (i.e., can cause marks and/or stains).

The chuck marks and stains are difficult to remove from the wafer. If the wafer is chucked on the side to be finish polished, the chuck mark acts as a mask and may alter the flatness and/or topology of the wafer. If the wafer is chucked on the back surface, the chuck mark alters the topology of the back surface and may possibly impact CMP film uniformity.

SUMMARY OF THE INVENTION

In one aspect, the present invention is directed to a method of polishing a semiconductor wafer. The wafer has a front surface, a back surface, a notch, and an edge. The method generally comprises polishing at least one of the surfaces of the wafer using a polishing pad and slurry and polishing the notch of the wafer using a polishing pad and slurry. The at least one surface is cleaned of residual slurry. The cleaned surface of the wafer is grasping by applying a vacuum thereto using a vacuum chuck. The edge of the wafer is polished using a pad and slurry while the wafer is grasped by the vacuum chuck.

In another aspect, a method generally comprises polishing the notch of the wafer at a notch polishing station using a polishing pad and slurry. The wafer is transferred from the notch polishing station to a surface polishing station. At least one of the surfaces of the wafer is polished at the surface polishing station using a polishing pad and slurry. At least one surface of the wafer is cleaned of residual slurry. The wafer is transferred to an edge polishing station. The cleaned surface of the wafer is grasped by applying a vacuum thereto using a vacuum chuck. The edge of the wafer is polished using a pad and slurry while the wafer is grasped by the vacuum chuck.

In yet another aspect, a method generally comprises cleaning the wafer and grasping the cleaned wafer by applying a vacuum to one of the surfaces of the wafer using a vacuum chuck. The edge of the wafer is polished using a pad and slurry while the wafer is grasped by the vacuum chuck. The wafer is released from the vacuum chuck. The notch of the wafer is polished using a pad and slurry.

In still another aspect, a method comprises polishing the notch of the wafer using a polishing pad and slurry. The wafer is grasped using a clamp and edge polished using a pad and slurry while the wafer is grasped by the clamp.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DESCRIPTION OF THE PREFERRED EMBODIMENTS

Figure 1:
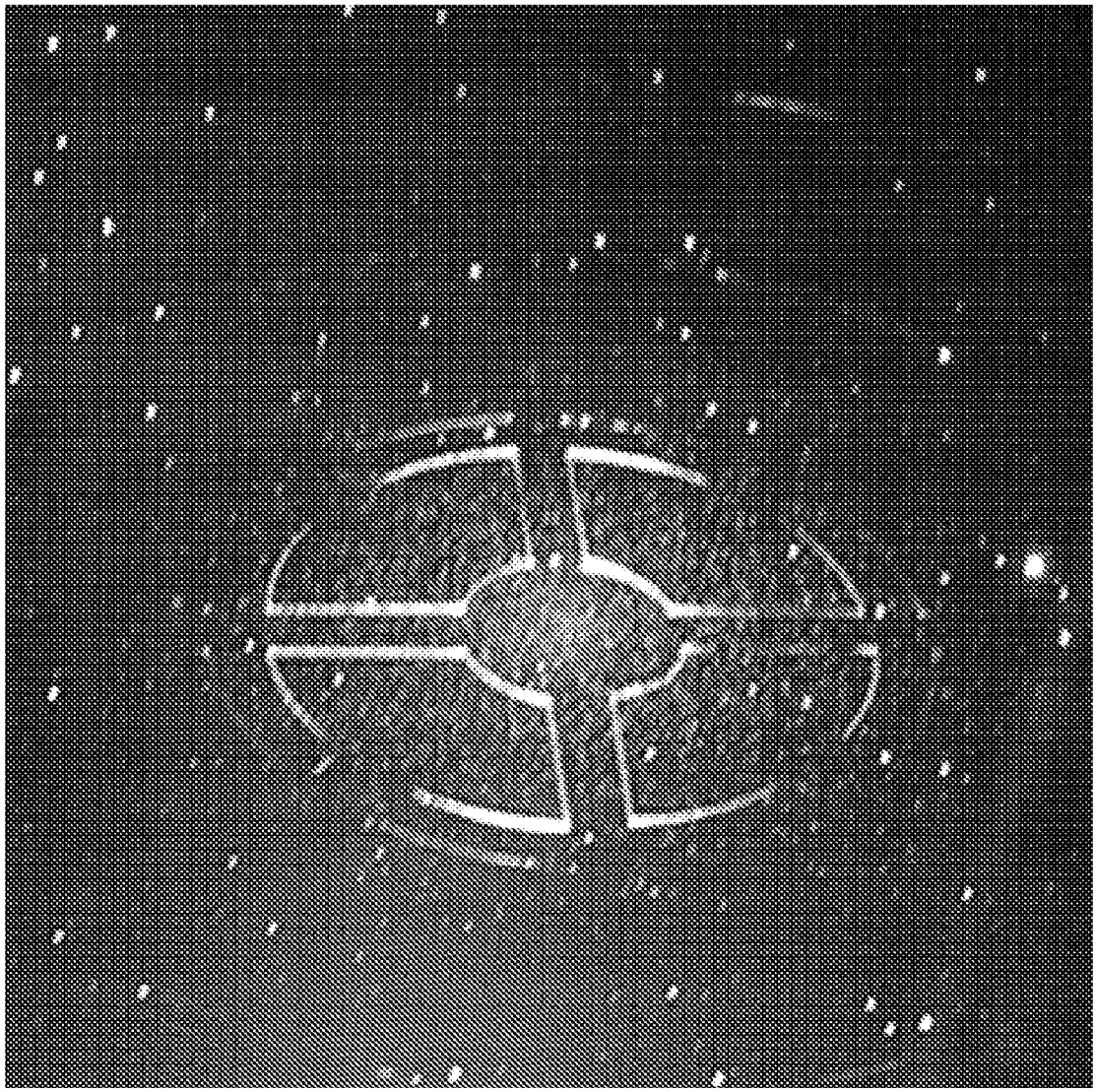
FIG. 1 PRIOR ART
FIG. 1 is an image of a chuck mark on a prior art wafer that was formed by a vacuum chuck during edge polishing of the wafer.
Figure 2:
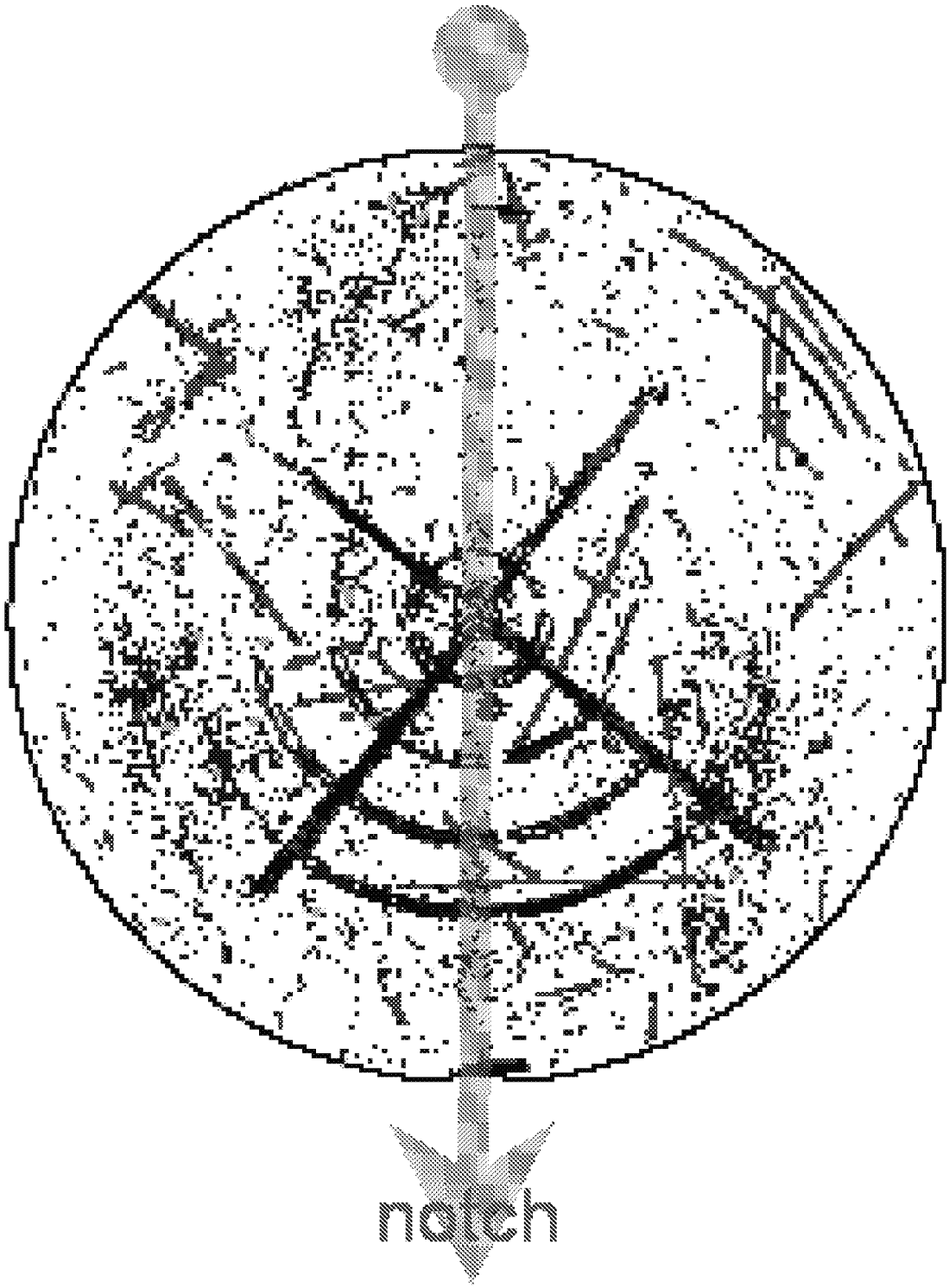
FIG. 2 PRIOR ART
FIG. 2 is a stackmap of twenty (20) prior art wafers generated by a wafer surface inspection tool.
Figure 3A:
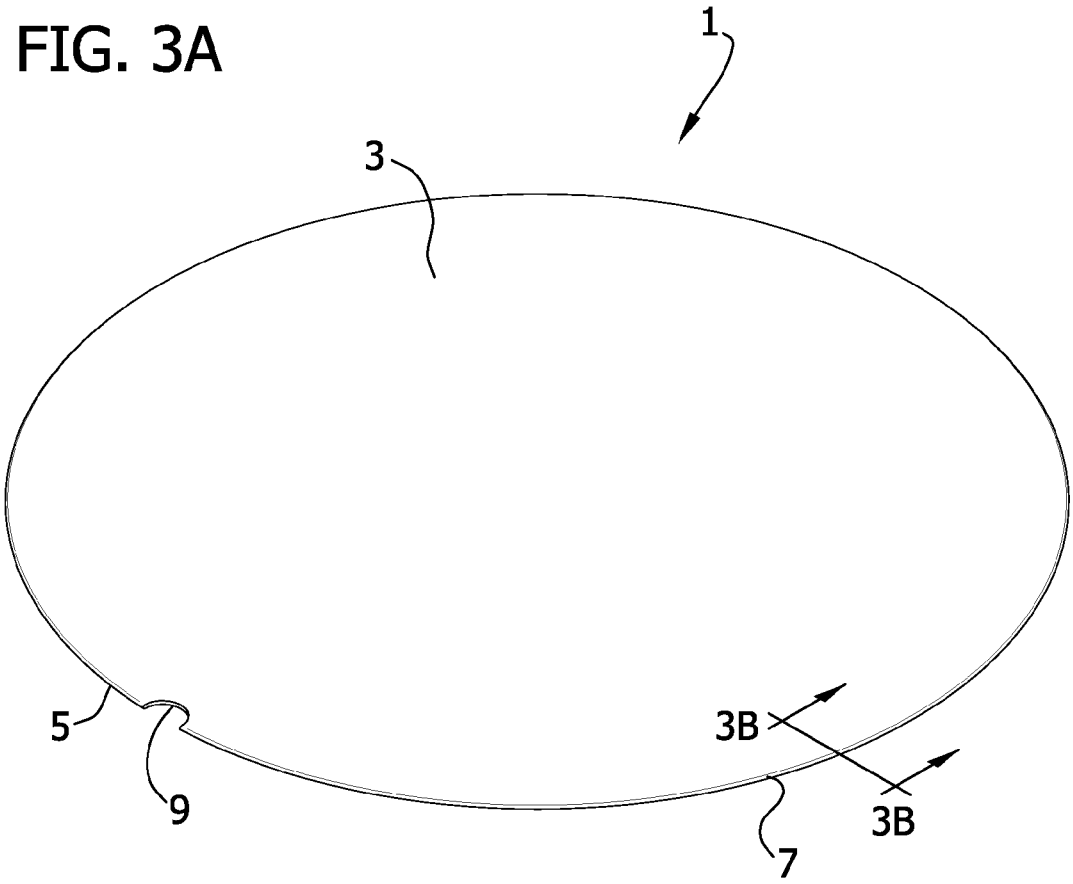
FIG. 3A is a perspective of a semiconductor wafer.
Figure 3B:
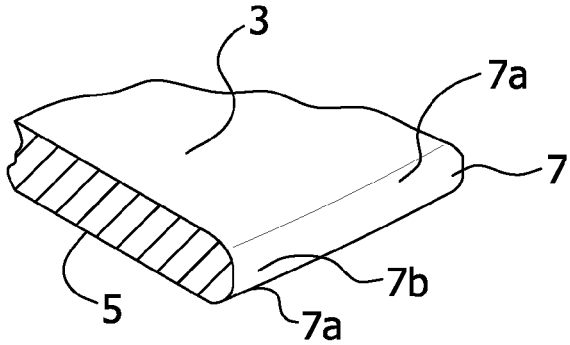
FIG. 3B is an enlarged section taken along 3B-3B of FIG. 3A.

Referring now to the drawings, FIGS. 3A and 3B show a semiconductor wafer, indicated generally at 1, having a front surface 3, a back surface 5, an edge 7, and a notch 9. The edge 7 of the wafer 1 includes two bevels 7*a* and an apex 7*b* intermediate the bevels. For some applications, it is desired that the entire wafer 1 including the front surface 3, the back surface 5, the edge 7, and the notch 9 is polished. The illustrated wafer 1 is a 300 mm wafer but it is understood that the wafer can have different sizes without departing from the scope of this invention.

Figure 4:
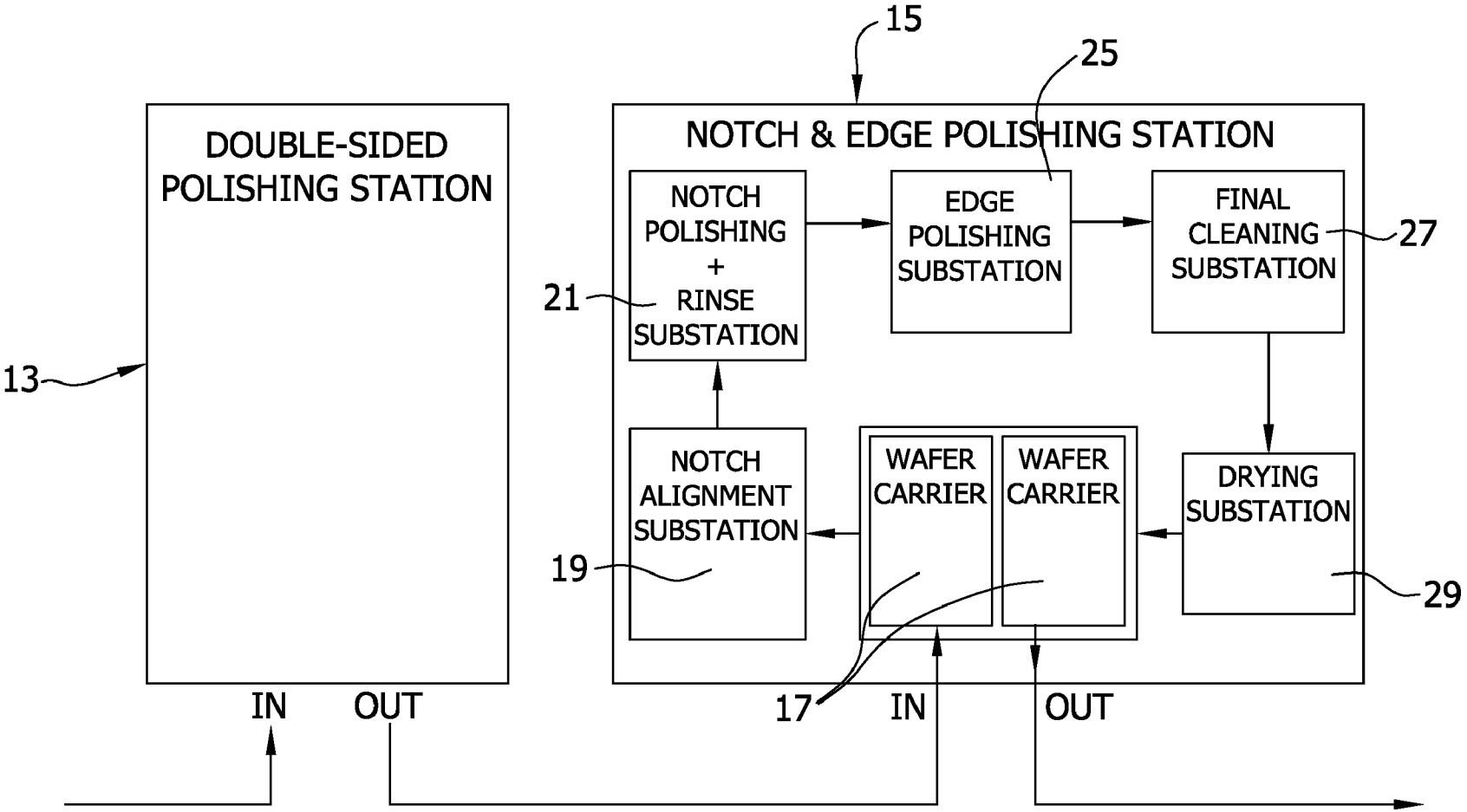
FIG. 4 is a schematic illustrating a first embodiment of a method of the present invention.

FIG. 4 schematically illustrates one embodiment of a process of polishing semiconductor wafers 1 in accordance with the present invention. As illustrated, the polishing process includes two stations: 1) a double-sided polishing station, indicated generally at 13, and 2) a notch and edge polishing station, indicated generally at 15. Arrows are used to illustrate the path traveled by the wafers 1 as the wafers proceed through the polishing stations 13, 15.

In use, a plurality of wafers 1 are delivered to the double-sided polishing station 13 where each of the wafers 1 is double-side polished. Methods for double-side polishing are known in the art, including those found, for example, in U.S. Pat. Nos. 5,110,428; 5,422,316; 5,952,242; 5,963,821; 6,043,156; 6,051,498; 6,162,730; 6,189,546; 6,376,335; and 7,008,308, the entire disclosures of which are hereby incorporated by reference.

The double-sided polishing station 13 is adapted to remove wafer material from both the front and back surfaces 3, 5 of the wafers 1 simultaneously. As a result of the double-sided polishing, both surfaces 3, 5 of the wafer 1 are flat, highly reflective, and substantially damage-free. It is understood that other types of polishing stations could be used without departing from the scope of this invention. For example, a single-sided polishing station could be used wherein only one surface of the wafer is polished.

After the wafers 1 are double-side polished, the wafers are transferred, such as by a robotic arm, to the notch and edge polishing station 15 in a wafer carrier 17. Each of the wafers 1 is individually removed from the wafer carrier 17 and is moved to a notch alignment substation 19. The notch 9 in the wafer 1 is aligned at the notch alignment substation 19. The wafer 1 is moved from the notch alignment substation 19 to the notch polishing and rinse substation 21. The notch 9 of the wafer 1 is polished at the notch polishing and rinse substation 21 using a pad and slurry as is know in the art. For example, an abrasive pad in the form of a disk, such as a Suba IV abrasive pad, which is commercially available from Rodel Co. (Newark, Del.), is rotated at approximately 500 to 1,000 RPM and is applied to the notch 9 of the wafer 1 with a polishing pressure of about 40 to 65 N of force while applying polishing slurry comprising a colloidal silica and about 1 to about 3% potassium hydroxide. Upon completion of the notch polishing, the wafer 1 has a highly polished notch 9. It is understood that the notch 9 can be polished using other notch polishing methods.

After notch polishing, the front and back surfaces 3, 5 of the wafer 1 contain residual slurry. The wafer 1 is washed at the notch polishing and rinse substation 21 to clean the slurry from the wafer using spray nozzles that deliver a cleaning fluid to one or both surfaces of the wafer. In one configuration, both the front and back surfaces 3, 5 of the wafer 1 are cleaned to remove the residual slurry left from the notch polishing process. It is understood, however, that only one of the surfaces 3, 5 (i.e., the surface to be vacuum chucked as described later herein) needs to be cleaned.

During washing of the wafer surfaces 3, 5, the cleaning fluid is used to rinse the residual slurry from the wafer 1. In one configuration, a spray nozzle is used to spray cleaning fluid onto the wafer 1 and thereby rinse the slurry off of the wafer. It has been determined that an effective flow rate at which to spray the wafer 1 with cleaning fluid is approximately 2.5 to 3 liters per minute for a duration of 1 to 10 seconds. The notch polishing and rinse substation 21 may include a plurality of spray nozzles so that a plurality of wafers can be cleaned simultaneously. For example, in one configuration, the notch polishing and rinse substation 21 includes seven spray nozzles for rising up to seven wafers simultaneously.

Cleaning fluids suitable for cleaning the residual slurry from the wafers 1 include DI water, ammonium hydroxide (NH4OH, 5% concentration) SC1 (NH4OH+H2O2+H2O at 1:2:50 by volume), TMAH ((CH3)4NOH, tetramethylammonium hydroxide at 50 ml 25% concentration solution in 1 liter of water), citric acid (C6H8O7, at 0.05 to 5 grams per liter) and citric acid plus hydrogen peroxide (5 grams per liter citric acid plus 4 liters of concentration peroxide per 100 liter of water). It is understood that other cleaning fluids could be used to clean slurry from the wafer 1.

Cleaning fluids including $NH_4OH$ and tetramethylammonium hydroxide are alkaline and clean the wafer by dissolving the silica. They are effective at a pH >10.2, more effective at a pH >10.7 and very effective at pH >11.2. Very high pH (for example >12.5) should be avoided, since at very high pH the wafer surface may become pitted by the alkaline etching of the cleaning fluid. Pitting and etching damage can be minimized by the addition of a suitable oxidizing agent, such as hydrogen peroxide. This oxidizing agent will oxidize the silicon surface and reduce the etching and pitting action. It is understood that other alkaline cleaning fluids besides those listed herein could be used.

Cleaning fluids including citric acid (or malaic acid, lactic acid, oxalic acid, etc.) are acidic and act to precipitate the colloidal silica. They also reduce the pH of the solution, stopping or inhibiting any polishing or etching of the slurry on the silicon surface. These chemicals are effective at pH<6, more effective at pH<4.5 and very effective at pH<3. Very strong acids at very low pH, while effective at neutralizing the residual polishing slurry on the wafer surface, are very aggressive to metal components in the edge polishing machine and are to be avoided because of the potential for damaging the equipment. Also a small residue of chemical at very low pH may mix with polishing slurry and return to the polishing slurry tank. In this case, the acid neutralizes some of the polishing slurry and reduces the pH, thereby shortening the useable lifetime of the slurry. It is understood that other acidic cleaning fluids besides those listed could be used.

After the wafer 1 has been cleaned of residual slurry, the wafer is transferred to an edge-polishing substation 25 wherein the edge 7 of the wafer is polished. The edge polishing substation 25 is adapted to hold the wafer 1 and polish the bevels 7*a* and apex 7*b* of the edge 7. More specifically, the edge polishing substation 25 includes a vacuum chuck for holding the wafer 1 and a polishing tool having padded surfaces adapted to contact and polish the bevels 7*a* and apex 7*b* of the edge 7. Polishing slurry is also used during the polishing process. Upon completion of edge polishing, the wafer 1 has a highly polished edge 7. Since the wafer 1 was rinsed of residual slurry from notch polishing before being grasped by the vacuum chuck, the chucked surface of the wafer is free of chuck marks/stains. It is understood that the edge 7 of the wafer 1 can be polished using other methods.

After edge polishing, the wafer 1 again contains residual slurry. As a result, the wafer 1 is transferred to a final cleaning substation 27 for cleaning the slurry from the wafer. After the wafer 1 is sufficiently cleaned at the final cleaning substation 27, the wafer is transferred to a drying substation 29 wherein the wafer is spun dry. The drying substation 29 is adapted to hold the wafer 1 horizontally and rotate the wafer at high speed to blow cleaning liquid residues off the wafer surface by centrifugal force. Other wafer drying methods can also be used within the scope of this invention. From the drying substation 29, the wafer 1 is transferred back to the wafer carrier 17 where it can be transferred to another processing station.

In one configuration, the edge and notch polishing station 15 comprises a modified Speedfam EP-300-X polishing apparatus which is commercially available from Speedfam Co. (Kanagawa, Japan). More particularly, the polishing apparatus is modified to include one or more spray nozzles, pumps, and cleaning fluid reservoirs for rinsing the residual slurry from the wafer after notch polishing. In this particular configuration, the apparatus contains seven spray nozzles, one pump and one reservoir. It is understood that more or fewer spay nozzles, pumps, and reservoirs could be used within the scope of the present invention.

In summary, one embodiment of present invention is directed to a process of producing vacuum chuck mark/stain free wafers 1 that are flat and have highly polished surfaces 3, 5 and edges 7. The process includes 1) polishing the front and back surfaces 3, 5 of the wafer 1 using double-side polishing at the double-sided polishing station 13; 2) transferring the wafer from the double-sided polishing station to the notch and edge polishing station 15; 3) aligning the notch 9 in the wafer at the notch alignment substation 19; 4) polishing the notch of the wafer at notch polishing and rinse substation 21; 5) cleaning the wafer of residual slurry from notch polishing; 6) polishing the edge of the wafer at the edge polishing substation 25; 7) cleaning the wafer at the final cleaning substation 27; and 8) spin drying the wafer at the drying substation 29. After the wafer 1 is dried, the wafer is returned to the wafer carrier 17 were it can be transferred to another processing station.

Figure 5:
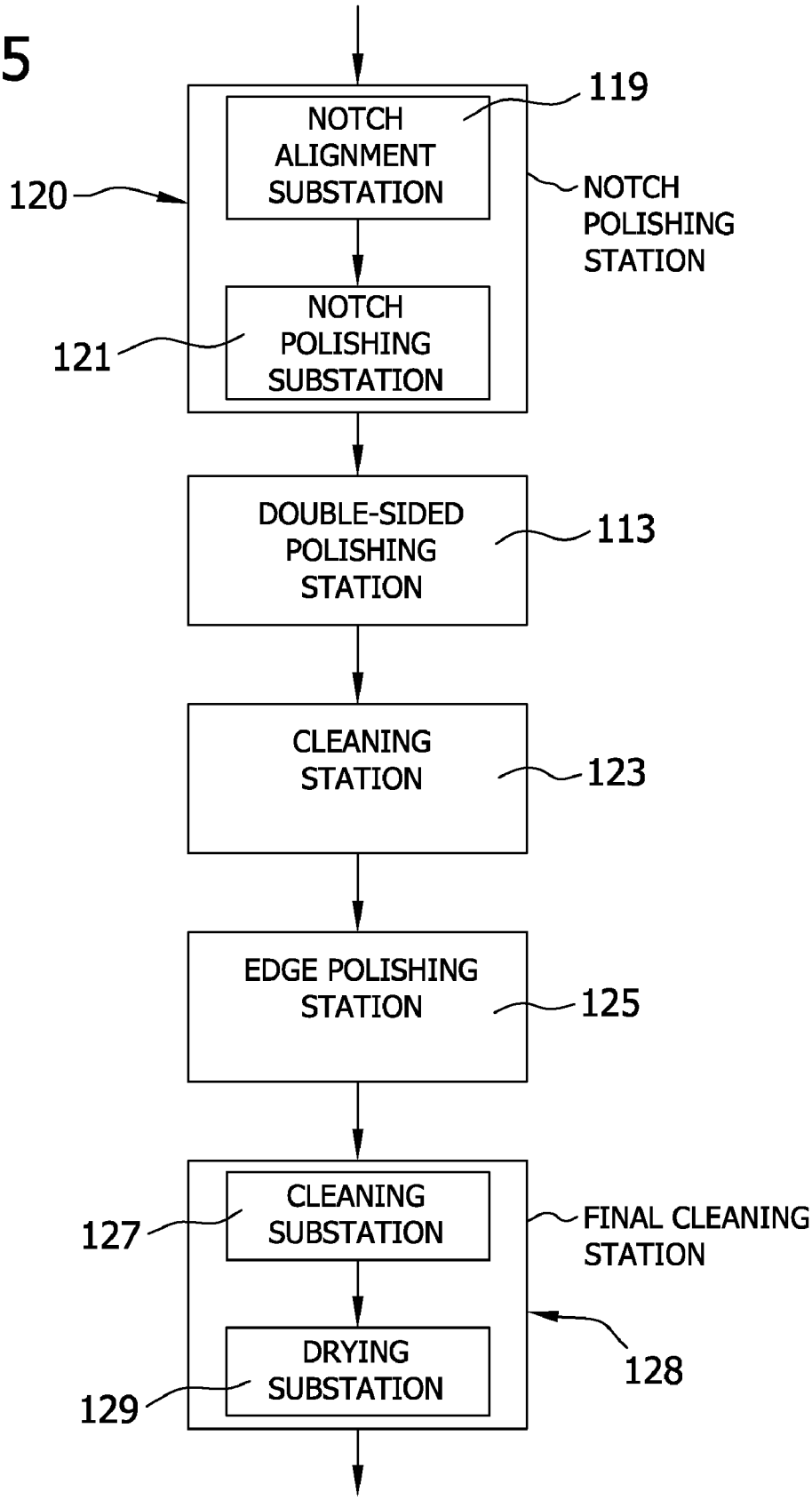
FIG. 5 is a schematic illustrating a second embodiment of a method of the present invention.

In a second embodiment, which is schematically illustrated in FIG. 5, vacuum chuck stains/marks are eliminated by polishing the notch 9 of the wafer 1 before the front and/or back surfaces 3, 5 of the wafer are polished. After the surfaces 3, 5 of the wafer 1 are polished, the wafer is cleaned. The edge 7 of the wafer 1 is polished after the wafer is cleaned. As a result, the wafer 1 is free of residual slurry when it is vacuum chucked during edge polishing, thereby eliminating the formation of any chuck stains/marks on the wafer during the chucking process.

In this embodiment, a plurality of wafers 1 are transferred to a notch polishing station, indicated generally at 120, in a wafer carrier (not shown). Each of the wafers 1 is individually removed from the wafer carrier and its notch 9 aligned at a notch alignment substation 119. The wafer 1 is moved from the notch alignment substation 119 to the notch polishing substation 121 where the notch 9 of the wafer is polished using a pad and slurry as is know in the art. Upon completion of the notch polishing, the wafer 1 has a highly polished notch 9. It is understood that the notch 9 can be polished using other methods.

After notch polishing, the wafer 1 is transferred from the notch polishing station 120 to a double-sided polishing station 113 that is adapted to remove wafer material from both the front surface 3 and the back surface 5 of the wafer simultaneously. As a result of the double-sided polishing, both surfaces 3, 5 of the wafer are flat, highly reflective, and substantially damage-free.

After the wafer 1 is double-sided polished, the wafer is transferred to a cleaning station 123 where the wafer is cleaned of any residual slurry from either the notch polishing process or the double-side polishing process. It is understood, however, that only one of the surfaces 3, 5 (i.e., the surface to be vacuum chucked as described later herein) can be cleaned. At the cleaning station 123, a cleaning fluid is used to remove any residual slurry from the wafer. The wafer 1 can be cleaned using conventional methods known to those skilled in the art. It is understood that the cleaning station 123 can be part of the double-sided polishing station 113 or a separate station therefrom.

After the wafer 1 has been cleaned of residual slurry, the wafer is transferred to an edge polishing station 125 wherein the edge 7 of the wafer is polished. In one configuration, the edge polishing station 125 is separate and spaced from the notch polishing station 120. But it is understood that the notch and edge polishing could be performed at a combined station as described above. The edge polishing station 125 is adapted to hold the wafer 1 and polish the bevels 7*a* and apex 7*b* of the edge 7. More specifically, the edge polishing station 125 includes a vacuum chuck for holding the wafer 1 and a polishing tool having padded surfaces adapted to contact and polish the bevels 7*a* and edge 7*b*. Since the wafer 1 was cleaned of any residual slurry before being grasped by the vacuum chuck, the chucked surface of the wafer is free of chuck marks/stains. Upon completion of edge polishing, the wafer 1 has a highly polished edge 7.

After edge polishing, the wafer 1 again contains residual slurry. As a result, the wafer 1 is transferred to a final cleaning station, indicated generally at 128, for cleaning the slurry from the wafer at a cleaning substation 127. After the wafer 1 is sufficiently cleaned at the cleaning substation 127, the wafer is transferred to a drying substation 129 wherein the wafer is spun dry. From the drying substation 129, the wafer 1 is transferred to a wafer carrier (not shown) where it can be transferred to another processing station. It is understood that the final cleaning station 128 can be part of the edge polishing station 125 or a separate station therefrom.

In summary, the second embodiment of present invention is directed to a process of producing vacuum chuck mark/stain free wafers 1 that are flat and have highly polished surfaces 3, 5 and edges 7. The process includes 1) transferring the wafer 1 to the notch polishing station 120; 2) aligning the notch 9 of the wafer at the notch alignment substation 119; 3) polishing the notch of the wafer at notch polishing substation 121; 4) transferring the wafer to the double-sided polishing station 113; 5) polishing the front and back surfaces 3, 5 of the wafer using double-side polishing; 6) transferring the wafer from the double-sided polishing station to a cleaning station 123; 7) cleaning the wafer at the cleaning station; 8) transferring the wafer to the edge polishing station 125; 9) polishing the edge 7 of the wafer at the edge polishing substation; 10) final cleaning the wafer at a final cleaning station 128; and 11) spin drying the wafer. After the wafer 1 is dried, the wafer is returned to a wafer carrier were it can be transferred to another processing station.

Figure 6:
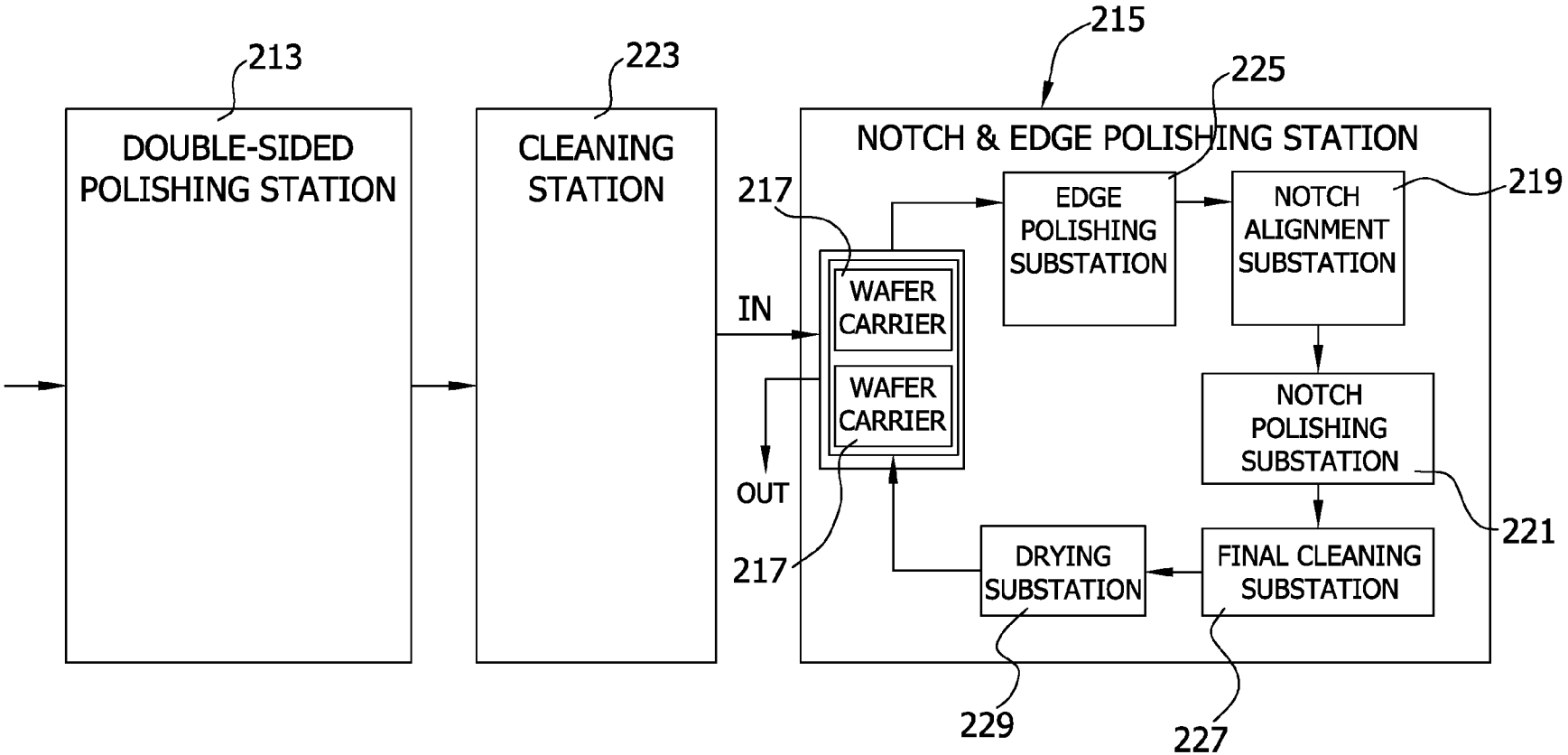
FIG. 6 is a schematic illustrating a third embodiment of a method of the present invention.

In a third embodiment of the present invention, which is schematically illustrated in FIG. 6, vacuum chuck stains/marks are eliminated by polishing the notch 9 of the wafer 1 after the edge 7 of the wafer has been polished. By polishing the edge 7 of the wafer 1 before polishing the notch 9 of the wafer, the wafer is clean and free of residual slurry when the wafer is vacuum chucked during edge polishing.

In this embodiment, a plurality of the wafers are transferred to a double-sided polishing station 213 that is adapted to remove wafer material from both the front surface 3 and the back surface 5 of the wafer 1 simultaneously. As a result of the double-sided polishing, both surfaces 3, 5 of the wafer 1 are flat, highly reflective, and substantially damage-free. It is understood, however, that the polishing station could be adapted to polish only one of the surfaces 3, 5 of the wafer 1.

After the wafer 1 is double-sided polished, the wafer is transferred to a cleaning station 223 where the wafer is cleaned of any residual slurry from the double-side polishing process. It is understood, however, that only one of the surfaces 3, 5 (i.e., the surface to be vacuum chucked as described later herein) can be cleaned. At the cleaning station 223, a cleaning fluid is used to remove any residual slurry from the wafer 1. The wafer can be cleaned using conventional methods known to those skilled in the art. It is understood that the cleaning station 223 can be part of the double-sided polishing station 213 or a separate station therefrom.

After the wafer 1 has been cleaned of residual slurry, the wafer is transferred to an edge and notch polishing station 215 in a wafer carrier 217. The wafer 1 removed from the wafer carrier 217 and moved to an edge polishing substation 225 where the edge 7 of the wafer is polished. The edge polishing substation 225 is adapted to hold the wafer 1 and polish the bevels 7*a* and apex 7*b* of the edge 7. More specifically, the edge polishing substation 225 includes a vacuum chuck for holding the wafer 1 and a polishing tool having padded surfaces adapted to contact and polish the bevels 7*a* and edge 7*b*. Since the wafer 1 was clean of any residual slurry before being grasped by the vacuum chuck, the chucked surface of the wafer is free of chuck marks/stains. Upon completion of edge polishing, the wafer 1 has a highly polished edge 7.

From the edge polishing substation 225, the wafer 1 is moved to a notch alignment substation 219 where the notch 9 of the wafer is aligned. The wafer 1 is then moved from the notch alignment substation 225 to a notch polishing substation 219. The notch 9 of the wafer 1 is polished at the notch polishing substation 219 using a pad and slurry as is know in the art. Upon completion of the notch polishing, the wafer 1 has a highly polished notch 9.

After the wafer 1 is notch polished, the wafer is transferred to a final cleaning substation 227 for cleaning residual slurry from the wafer. Once the wafer 1 is sufficiently cleaned at the cleaning substation 227, the wafer is transferred to a drying substation 229 wherein the wafer is spun dry. From the drying substation 229, the wafer 1 is transferred back to the wafer carrier 217 where it can be transferred to another processing operation.

In summary, the third embodiment of present invention is directed to a process of producing vacuum chuck mark/stain free wafers 1 that are flat and have highly polished surfaces and edges. The process includes 1) transferring the wafer 1 to the double-sided polishing station 213; 2) polishing the front and back surfaces 3, 5 of the wafer using double-side polishing; 3) cleaning any residual slurry from the wafer at the cleaning station 223; 4) transferring the wafer to the edge and notch polishing station 215; 5) polishing the edge 7 of the wafer the edge polishing substation 225; 6) aligning the notch 9 of the wafer at the notch alignment substation 219; 7) polishing the notch 9 of the wafer at the notch polishing substation 221; 8) cleaning the wafer of residual slurry at the final cleaning substation 227; and 10) spin drying the wafer at the drying substation 229. After the wafer 1 is dried, the wafer is returned to the wafer carrier 217 were it can be transferred to another processing station.

In a fourth embodiment, vacuum chuck stains/marks are eliminated from the wafers 1 by eliminating the use of a vacuum chuck during edge polishing. As previously mentioned, vacuum chuck marks are caused by slurry drying on the wafer 1 during edge polishing when the wafer is grasped by a vacuum chuck. The residual slurry dries on the wafer surface due to the evaporation of water and any other volatile liquids in the polishing slurry when a vacuum is applied to chuck the wafer. By eliminating the vacuum chuck, the evaporation of water and/or other volatile liquids in the polishing slurry does not occur and chuckmarks/stains on the wafer surface are not formed. Thus, eliminating the use of the vacuum chuck during edge polishing eliminates the stains/marks associated therewith. Other types of chucks (e.g., electrostatic chucks, clamps) are known in the art but are not currently used during edge polishing. In one configuration, the wafer 1 can be chucked at the edge polish station by clamping the wafer between two rigid, pad-covered plates at a controlled predetermined pressure. The edges of the wafer can be polished while the wafer is grasped by the plates.

EXAMPLE

Approximately 2,000 wafers were polished in accordance with the first embodiment of this invention using a modified notch and edge polishing apparatus. More specifically, a Speedfam EP-300-X polishing apparatus which is commercially available from Speedfam Co. (Kanagawa, Japan) was modified to add a cleaning substation between a notch polishing substation and an edge polishing substation. Seven spray nozzles, a pump, and a cleaning fluid reservoir were added to the polishing apparatus so that any residual slurry on the wafers after notch polishing would be removed before the wafers were edge polished.

During the testing, 300 mm wafers were notch aligned and notch polished in a conventional manner using the Speedfam EP-300-X. As a result, the wafers had residual slurry after notch polishing. After notch polishing, the wafers were cleaned at the cleaning substation using one of the following cleaning fluids: 1) ammonium hydroxide ($NH_4OH$, 5% concentration) SC1 ($NH_4OH+H_2O_2+H_2O$ at 1:2:50 by volume); 2) TMAH ($(CH_3)_4NOH$, tetramethylammonium hydroxide at 100 ml 25% concentration solution in 1 liter of water); 3) citric acid ($C_6H_8O_7$, at 0.05 to 5 grams per liter); and 4) citric acid plus hydrogen peroxide (5 grams per liter citric acid plus 4 liters of conc. peroxide per 100 liter of water). Each of the wafers was sprayed with the cleaning fluid at approximately 2.5 to 3 liters per minute for a duration of 1 to 10 seconds.

After the wafers were cleaned, the wafers were transferred to the edge polishing substation for edge polishing. The edges of each of the wafers were polished in a conventional manner using the Speedfam EP-300-X, which includes using a vacuum chuck to grasp and hold the wafer during edge polishing. After edge polishing, the wafers were cleaned and dried by the Speedfam EP-300-X in its conventional manner.

The wafers were then inspected. No chuck marks were observed on any of the wafers that were cleaned in accordance with the present invention before the edges of the wafers were polished.

The present invention is directed to a process of producing mark/stain free wafers while allowing an edge of the wafer to be polished after at least one surface of the wafer. As a result, wafers produced in accordance with the present invention are more flat, have greater reflectivity, and have less damaged surfaces and edges than prior art wafers. Accordingly, the present invention provides for wafers that are well suited for advanced applications.

When introducing elements of the present invention or embodiments thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above methods without departing from the scope of the invention, it is intended that all matter contained in the above description and shown in the accompanying drawings shall be interpreted as illustrative and not in a limiting sense.

What is claimed is:

1. A method of polishing a semiconductor wafer, the wafer having a front surface, a back surface, a notch, and an edge, the method comprising:

polishing at least one of the surfaces of the wafer using a polishing pad and slurry;

polishing the notch of the wafer using a polishing pad and slurry;

cleaning at least one surface of the wafer of residual slurry;

grasping the cleaned surface of the wafer by applying a vacuum to the cleaned surface of the wafer using a vacuum chuck; and edge polishing the wafer using a pad and slurry while the cleaned surface of the wafer is grasped by the vacuum chuck.

2. The method as set forth in claim 1 wherein cleaning at least one surface of the wafer of residual slurry comprises cleaning both the front and back surfaces of the wafer of residual slurry.

3. The method as set forth in claim 1 wherein cleaning at least one surface of the wafer of residual slurry comprises spraying a cleaning fluid on the wafer to clean at least one surface of the wafer.

4. The method as set forth in claim 3 further comprising spraying cleaning fluid on the wafer at a flow rate of approximately 2.5 to 3 liters per minute for a duration of 1 to 10 seconds.

5. The method as set forth in claim 4 further comprises using citric acid as the cleaning fluid.

6. The method as set forth in claim 3 wherein the cleaning fluid is an alkaline fluid having a pH greater than 10.2

7. The method as set forth in claim 6 wherein the alkaline fluid has a pH greater than 10.7.

8. The method as set forth in claim 7 wherein the alkaline fluid has a pH greater than 11.2 and less than 12.5.

9. The method as set forth in claim 6 wherein the cleaning fluid comprises an oxidizing agent.

10. The method as set forth in claim 9 wherein the oxidizing agent is hydrogen peroxide.

11. The method as set forth in claim 3 wherein the cleaning fluid is an acidic fluid having a pH less than 6.

12. The method as set forth in claim 11 wherein the acidic fluid has a pH less than 4.5.

13. The method as set forth in claim 12 wherein the acidic fluid has a pH less than 3.

14. The method as set forth in claim 3 further comprising selecting the cleaning fluid from a group consisting of ammonium hydroxide, tetramethylammonium hydroxide, citric acid, citric acid plus hydrogen peroxide, tetramethylammonium hydroxide plus hydrogen peroxide, ammonium hydroxide plus hydrogen peroxide, and DI water.

15. A method of polishing a semiconductor wafer, the wafer having a front surface, a back surface, a notch, and an edge, the method comprising:

polishing the notch of the wafer at a notch polishing station using a polishing pad and slurry;

transferring the wafer from the notch polishing station to a surface polishing station;

polishing at least one of the surfaces of the wafer at the surface polishing station using a polishing pad and slurry;

cleaning at least one surface of the wafer of residual slurry;

transferring the wafer to a edge polishing station, grasping the cleaned surface of the wafer by applying a vacuum to the cleaned surface of the wafer using a vacuum chuck; and edge polishing the wafer using a pad and slurry while the cleaned surface of the wafer is grasped by the vacuum chuck.

16. The method as set forth in claim 15 wherein transferring the wafer to an edge polishing station comprises transferring the wafer to an edge polishing station spaced from the notch polishing station.

17. The method as set forth in claim 15 wherein polishing at least one of the surfaces of the wafer at the surface polishing station comprises polishing both the front and back surfaces of the wafer.

18. The method as set forth in claim 15 wherein grasping the cleaned surface of the wafer by applying a vacuum to the cleaned surface of the wafer using a vacuum chuck comprises applying a vacuum to the front surface of the wafer.

19. A method of polishing a semiconductor wafer, the wafer having a front surface, a back surface, a notch, and an edge, the method comprising:

cleaning the wafer;

grasping the cleaned wafer by applying a vacuum to one of the surfaces of the wafer using a vacuum chuck;

edge polishing the cleaned wafer using a pad and slurry while the wafer is grasped by the vacuum chuck;

releasing the wafer from the vacuum chuck; and notch polishing the wafer using a pad and slurry.

20. The method as set forth in claim 19 further comprising polishing at least one surface of the wafer using a polishing pad and slurry.

21. The method as set forth in claim 20 wherein polishing at least one surface of the wafer using a polishing pad and slurry is performed before the wafer has been notch polished.

* * * * *